United States Patent [19]

Bunz

[11] Patent Number: 4,800,738

[45] Date of Patent: Jan. 31, 1989

[54] GEM SETTING

[76] Inventor: Georg Bunz, Obere Bergstrasse 16, D-7544 Dobel, Fed. Rep. of Germany

[21] Appl. No.: 3,263

[22] Filed: Jan. 14, 1987

[30] Foreign Application Priority Data

Jan. 17, 1986 [DE] Fed. Rep. of Germany ... 8601026[U]

[51] Int. Cl.[4] ..... A44C 17/02

[52] U.S. Cl. ..... 63/26

[58] Field of Search ..... 63/26, 27, 29 R, 30

[56] References Cited

U.S. PATENT DOCUMENTS

| | | | |
|---|---|---|---|
| 470,751 | 3/1892 | Fink | 63/29 R |
| 499,823 | 6/1893 | Cranson | 63/29 R |
| 733,029 | 7/1903 | Gosling | 63/29 R |
| 2,141,363 | 12/1938 | Rigollet | 63/26 |
| 2,811,024 | 10/1957 | Thompson | 63/26 |
| 3,605,442 | 9/1971 | Parker et al. | 63/26 |
| 3,898,869 | 8/1975 | Reneer | 63/26 |
| 3,905,525 | 9/1975 | Kawamata | 63/29 R |

FOREIGN PATENT DOCUMENTS

| | | | |
|---|---|---|---|
| 260123 | 7/1949 | Switzerland | 63/26 |
| 2179236 | 3/1987 | United Kingdom | 63/26 |

*Primary Examiner*—Robert A. Hafer
*Assistant Examiner*—Michael Brown
*Attorney, Agent, or Firm*—Spencer & Frank

[57] ABSTRACT

A gem setting includes a holding body and a gem received therein in a predetermined position, an inner wall face forming a part of the holding body and defining a bore hole therein; a first depression in the inner wall face; and a second depression in a peripheral face of the gem. The peripheral face is received in the bore hole and the first and second depressions are in alignment with one another in the predetermined position of the gem. An elastic connecting member is nested simultaneously in both the first and second depressions for coupling the gem to the holding body. The elastic connecting member and the depth of one of the depressions is dimensioned with respect to one another such that the elastic connecting member is expandable into the depression during introduction of the gem into the bore hole until the first and second depressions arrive in mutual alignment with one another.

5 Claims, 1 Drawing Sheet

GEM SETTING

BACKGROUND OF THE INVENTION

This invention relates to a setting for a precious stone and includes a holding body such as a jewelry part into which the stone is inserted.

Gem settings of widely varying structures formed of more or less intricately shaped holding parts are known which require substantial skill on the part of the jeweler, rendering the setting process time consuming and expensive.

In case the stone is to be set in certain non-metallic materials such as acrylic glass or other synthetic materials, the usually applicable setting techniques can find only limited application. Further, for reasons of design or aesthetic considerations, often visible parts which partially cover the stone are not always desirable.

SUMMARY OF THE INVENTION

It is an object of the invention to provide an improved gem setting which may be used in various holding bodies or jewelry parts, for example, watch glasses or other usual jewelry such as bracelets or clasps.

This object and others to become apparent as the specification progresses, are accomplished by the invention, according to which, briefly stated, in the holding body a bore hole is provided which receives the gem and whose cross-sectional area at least partially corresponds to the cross-sectoional area of the gem. Further, in the wall of the bore hole and on a peripheral face of the gem, depressions are provided which are in alignment with one another when the gem is in position in the bore hole. An elastic connecting member is seated in the aligned depressions thus coupling the holding body to the gem. The depth of one of the depressions is so selected that the elastic connecting member may be caused to temporarily expand into that depression to such an extent that the stone may be inserted into or removed from the bore hole.

According to the invention, a sole supporting component is required and for inserting the gem no special tools are needed. The invention thus provides for a snap-in connection between the gem and the holding body.

According to a preferred embodiment of the invention, the depression in the bore wall and the depression in the gem are alignable annular grooves and the elastic connecting member is a discontinuous spring ring (circlip) which may be made, for example, of a platinum-iridium alloy so that, on the one hand, a superior spring force is maintained and, on the other hand, a snap-in and removal of the gem may be effected by a moderate force. The preferred embodiment provides a particularly simple and aesthetically pleasing setting.

DESCRIPTION OF THE PREFERRED EMBODIMENT

Figure 1:
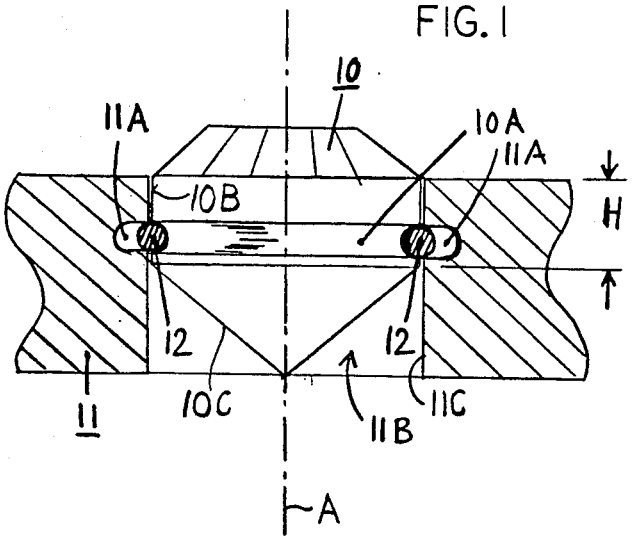
FIG. 1 is an axial sectional view of a preferred embodiment of the invention.
Figure 2:
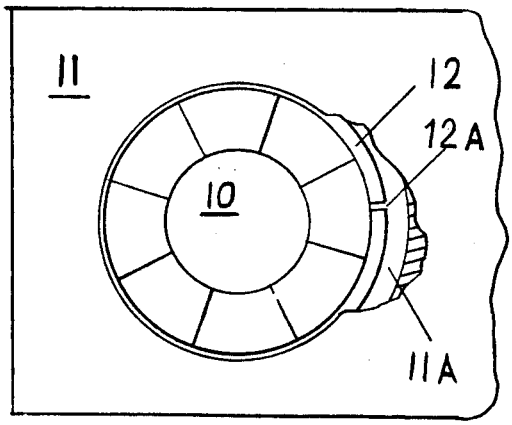
FIG. 2 is a top plan view of the structure shown in FIG. 1, with parts broken away to expose components to view.

Turning now to the Figures, the supporting body 11 may be a jewelry part of, for example, a bracelet or a watch cover. In the supporting body 11 a bore hole 11B is provided whose cross section is very slightly larger than that of the gem 10 in the support zone, and in the support zone the peripheral face 10B of the gem 10 is parallel with the bore axis A (which coincides with the gem axis) ensuring that the gem 10 is received in the bore hole 11B with only a slight play. In the peripheral face 10B of the gem 10 an annular groove 10A is provided which has a cross-sectionally semicircular configuration. In the cylindrical wall 11C of the bore hole 11B there is provided an annular groove 11A intended to be aligned with the groove 10A in the set position of the gem 10. The depth of the groove 11A provided in the supporting body 11 is greater than that of the annular groove 10A. In the annular groove 11A there is received a circlip 12 whose outer diameter in the relaxed state is greater than the diameter of the bore hole 11B so that the circlip 12, prior to the insertion of the gem 10, is held in the annular groove 11A. The circlip 12 has a discontinuity (gap) 12A.

The cross-sectional area of the circlip 12 is coordinated with the depth of the annular groove 11A such that the circlip 12, urged by the camming action of, for example, the oblique face 10C of the gem 10, may resiliently move into the groove 11A entirely and thus can free the passage in the bore 11B for allowing entrance of the gem 10 until the annular groove 10A of the gem 10 arrives into alignment with the annular groove 11A and thus the circlip 12, under the effect of its own elasticity, resiliently snaps into the annular groove 10A in the support zone H of the gem 10. It is to be understood that the depth of the annular groove 10A is smaller than the thickness of the circlip 12 to ensure a satisfactory locking.

Similarly to the manner in which the gem 10 may be introduced into the setting, by virtue of a pressure or pulling force the gem 10 may be removed from the setting as the circlip 12, urged by the camming action of, for example, a side wall of the groove 10A, moves resiliently into the annular groove 11A and thus releases the gem 10.

The present disclosure relates to subject matter contained in Federal Republic of Germany patent application No. G 86 01 026.3 (filed Jan. 17, 1986) which is incorporated herein by reference.

It will be understood that the above description of the present invention is susceptible to various modifications, changes and adaptations, and the same are intended to be comprehended within the meaning and range of equivalents of the appended claims.

What is claimed is:

1. A gem setting including a holding body and a gem received therein in a predetermined position, comprising (a) an inner wall face forming part of said holding body and defining a bore hole therein; said bore hole being dimensioned for receiving at least a portion of said gem;

(b) means defining a first annular groove in said inner wall face defining said bore hole; said first annular groove having a depth;

(c) means defining a second annular groove in a peripheral face of said gem; said peripheral face being received in said bore hole and said first and second annular grooves being in alignment with one another in said predetermined position; said second annular groove having a depth; and (d) a discontinuous metal spring ring being nested simultaneously in both said first and second annular grooves for coupling said gem to said holding body; said discontinuous metal spring ring and the depth of one of said annular grooves being dimensioned with respect to one another such that said discontinuous metal spring ring is expandable into said one of said annular grooves during introduction of said gem into said bore hole until said first and second annular grooves arrive in mutual alignment with one another.

2. A gem setting as defined in claim 1, wherein said discontinuous ring is a platinum-iridium alloy.

3. A gem setting as defined in claim 1, wherein said gem comprises first camming means for expanding said discontinuous metal spring ring into said first annular groove by a wedging effect during introduction of said gem into said bore.

4. A gem setting as defined in claim 3, wherein said gem comprises second camming means for expanding said discontinuous metal spring ring into said first annular groove by a wedging effect during removal of said gem from said bore.

5. A gem setting as defined in claim 3, wherein the depth of said first annular groove and cross-sectional area dimensions of said discontinuous metal spring ring are coordinated such that the discontinuous metal spring ring can resiliently move substantially entirely into the first annular groove.

* * * * *